US007663562B2

(12) United States Patent
Murano et al.

(10) Patent No.: US 7,663,562 B2
(45) Date of Patent: Feb. 16, 2010

(54) ANTENNA AND MANUFACTURING METHOD THEREOF

(75) Inventors: Shinsuke Murano, Kasama (JP); Toshiyuki Horikoshi, Hitachi (JP); Masahiko Kobayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 117 days.

(21) Appl. No.: 11/923,755

(22) Filed: Oct. 25, 2007

(65) Prior Publication Data

US 2008/0218419 A1 Sep. 11, 2008

(30) Foreign Application Priority Data

Oct. 25, 2006 (JP) ..... 2006-289965

(51) Int. Cl.
*H01Q 1/32* (2006.01)
*H01Q 19/10* (2006.01)

(52) U.S. Cl. ..... 343/713; 343/818

(58) Field of Classification Search ..... 343/711, 343/712, 713, 715, 818
See application file for complete search history.

(56) References Cited

U.S. PATENT DOCUMENTS 5,079,560 A * 1/1992 Sakurai et al. ..... 343/713
6,509,630 B1 * 1/2003 Yanagisawa ..... 257/668
7,342,549 B2 * 3/2008 Anderson ..... 343/770
7,345,640 B2 * 3/2008 Watari et al. ..... 343/713
2006/0109187 A1 5/2006 Strutt et al.

FOREIGN PATENT DOCUMENTS

| | | |
|---|---|---|
| JP | 2 1990-16606 | 2/1990 |
| JP | 2006-140789 | 6/2006 |
| WO | WO00/54324 | 9/2000 |

* cited by examiner

*Primary Examiner*—Shih-Chao Chen
(74) *Attorney, Agent, or Firm*—Antonelli, Terry, Stout & Kraus, LLP.

(57) ABSTRACT

An antenna according to the present invention comprises: a plurality of parallel disposed linear conductors; two insulating films between which the plurality of linear conductors are sandwiched; at least one cut portion formed in at least one of the plurality of linear conductors; and a feed point connected to at least one of the plurality of linear conductors. With this configuration, the segment of the linear conductor connected to the feed point provides a driven element, while the other end of the linear conductor opposite to the feed point connected end is electrically open so that the segment of the linear conductor extending beyond the cut portion provides a parasitic element.

10 Claims, 5 Drawing Sheets

ANTENNA AND MANUFACTURING METHOD THEREOF

CLAIM OF PRIORITY

The present application claims priority from Japanese application serial no. 2006-289965 filed on Oct. 25, 2006, the content of which is hereby incorporated by reference into this application.

BACKGROUND OF THE INVENTION

1. Field of the Invention

The present invention relates to antennas and methods for manufacturing them, which reduce overall size, make return loss characteristics broadband and simplify manufacturing process.

2. Description of Related Art

Some types of antennas which are, e.g., attached to a vehicle window, mounted in a vehicle cabin or mounted to a wireless communication device may be required to be invisible to users because of regulations or appearances. Generally, antennas are made invisible to users by using smaller diameter conductor lines or narrower width conductor films for antenna elements. For example, JP-A-2006-140789 (US2006/0109187) proposes an antenna in which a smaller diameter conductor (hereinafter referred to as "linear conductor") is sandwiched between two visible light transparent insulating films, thereby improving mountability. It also discloses that, in order to solve a problem of increased electrical resistance with decreasing conductor diameter, multiple linear conductors are parallel disposed for lowering electrical resistance, thereby reducing the antenna loss.

FIG. 9 illustrates a conventional antenna 91 in which a plurality of linear conductors are parallel disposed in order to broadband return loss characteristics. In the antenna 91, a plurality of parallel disposed linear conductors 92 are sandwiched between two insulating films 93, and the same side ends of the linear conductors 92 are connected to a feed point 95, thereby causing all of the linear conductors 92 to function as a driven element 96. Further, another plurality of parallel disposed linear conductors 92 are sandwiched between two insulating films 93 and located separately from the driven elements 96, thereby providing parasitic elements 97 of a resonant frequency different from that of the driven element 96.

This antenna 91 has some problems in that the overall size of the antenna tends to increase, and an extra step of forming the parasitic elements 97 is added to the manufacturing process. In addition, if the driven elements 96 and parasitic elements 97 are some distance apart, then the antenna 91 will have directionality, which presents a disadvantage when wishing to broadband an omni-directional antenna.

SUMMARY OF THE INVENTION

Under these circumstances, it is an object of the present invention is to solve the above problems and to provide an antenna capable of reducing the overall size of the antenna and of broadbanding the return loss characteristics. It is further object of the present invention to provide a method for manufacturing the antenna capable of simplifying the manufacturing process.

(1) According to one aspect of the present invention, an antenna comprises: a plurality of parallel disposed linear conductors; two insulating films between which the plurality of linear conductors are sandwiched; at least one cut portion formed in at least one of the plurality of linear conductors; and a feed point connected to at least one of the plurality of linear conductors.

In the above invention (1), the following modifications and changes can be made.

(i) The feed point is connected to the same side end of the plurality of linear conductors.

(ii) The at least one cut portion is formed in at least two of the plurality of linear conductors such that each cut portion is positioned at a different distance from a same side end of the linear conductors.

(iii) The two insulating films are removed at the at least one cut portion.

(2) According to another aspect of the present invention, a method for manufacturing an antenna includes the steps of: parallel disposing a plurality of linear conductors; sandwiching the plurality of linear conductors between two insulating films; and cutting at least one of the plurality of linear conductors at least one cut portion.

In the above invention (2), the following modifications and changes can be made.

(iv) The method for manufacturing an antenna further includes the steps of: connecting the same side end of the plurality of linear conductors to a feed point; and being electrically open at the other end thereof, thereby forming a driven element which is a portion of one of the linear conductors with one end connected to the feed point and forming a parasitic element which is a portion of one of the linear conductors extending beyond its cut portion.

(v) In the cutting step, the at least one of the plurality of linear conductors are cut at the at least one cut portion such that each cut portion is positioned at a different distance from a same side end of the linear conductors.

(vi) In the cutting step, the portions of the two insulating films between which the at least one cut portion is sandwiched are removed simultaneously with cutting the at least one of the plurality of linear conductors.

(3) According to another aspect of the present invention, a method for manufacturing an antenna with a predetermined length and at least one linear conductor being cut at, at least, one cut portion includes the steps of: forming a long-length antenna material by sandwiching a plurality of parallel disposed long-length linear conductors between two long-length insulating films; setting a cutter mold with the entire width or more of the antenna material for cutting the antenna material; setting a punch mold for punching out at least one of the linear conductors together with the insulating films at, at least, one position along the linear conductor at a predetermined distance from the cutter mold; and pressing together the cutter mold and punch mold against the antenna material.

In the above invention (3), the following modifications and changes can be made.

(vii) In the pressing step, a jig is used for holding together the cutter mold and punch mold.

Advantages of the Invention

The invention exhibits the following excellent advantages.

(1) It reduces the overall size of the antenna.

(2) It simplifies the manufacturing process of the antenna.

(3) It broadbands the return loss characteristics of the antenna.

DETAILED DESCRIPTION OF THE PREFERRED EMBODIMENTS

Preferred embodiments according to the present invention will be described below with reference to the accompanying drawings. However, the present invention is not limited to the embodiments described herein.

First Embodiment of the Invention

Figure 1:
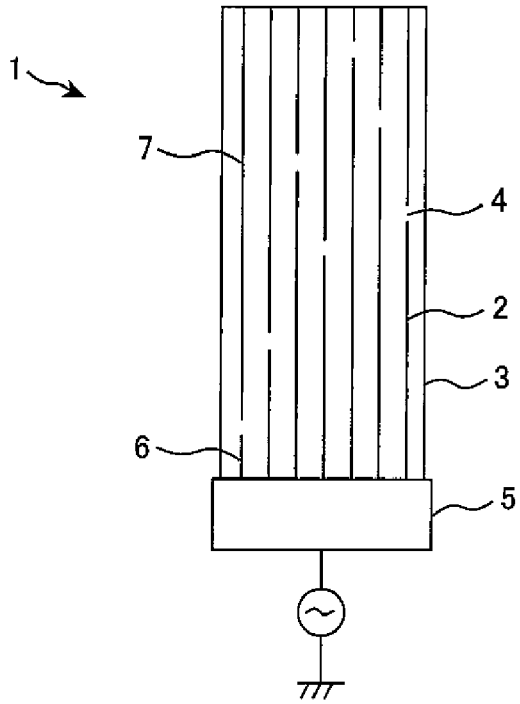
FIG. 1 is a schematic illustration showing a configuration of an antenna according to an embodiment of the present invention.

FIG. 1 is a schematic illustration showing a configuration of an antenna according to an embodiment of the present invention. As shown in FIG. 1, an antenna 1 according to the invention comprises: a plurality of (seven in the figure) parallel disposed linear conductors 2; two insulating films 3 between which the linear conductors 2 are sandwiched; at least one cut portions 4 formed in at least one of the linear conductors; and a feed point 5 connected to at least one of the linear conductors.

Also, in a manufacturing method of the antenna according to the present invention, the plurality of linear conductors 2 are parallel disposed and sandwiched between the two insulating films 3, and thereafter at least one of the linear conductors 2 are cut at least one cut portion 4.

In this embodiment, the feed point 5 is connected to the same side end of the seven linear conductors 2 so that the segment of the linear conductor 2 connected to the feed point 5 provides a driven element 6, while the other end of the linear conductor 2 is electrically open so that the segment of the linear conductor 2 extending beyond the cut portion 4 provides a parasitic element 7. In other words, one end of each driven element 6 is connected to the feed point 5 and the other end thereof is open at the cut portion 4, thereby constituting a monopole antenna. The segment of the linear conductor 2 extending beyond the cut portion 4 is open not only at the cut portion 4 but also at the other end, and therefore provides the parasitic element 7.

As shown in FIG. 1, all the seven linear conductors 2 are cut at one location, and differ in the distance from the end on the feed point 5 side to the end on the cut portion 4 side. This configures a multiple monopole antenna including seven parallel disposed driven elements 6 of different length and seven parallel disposed parasitic elements 7 of different length.

In manufacturing the antenna 1, it is preferable to firstly sandwich the linear conductors 2 having no cut portion 4 between the insulating films 3 and then remove them together by punching or cutting to form the cut portions 4, rather than to firstly preform the cut portions 4 in the linear conductors 2 and then sandwich them between the insulating films 3. A specific manufacturing method will be described later.

Next, the operation, function and advantage of the antenna will be described.

Consider here that a signal is fed to each driven element 6 from the feed point 5. This causes a current flow in each driven element 6. Here, each driven element 6 has a different resonant frequency because each one has a different length. Such a difference in resonant frequency among the multiple driven elements 6 broadbands the return loss characteristics.

Further, the parasitic element 7 disposed parallel to the driven element 6 is electrically coupled with an adjacent linear conductor 2 (driven element 6 or parasitic element 7) to create a resonance therebetween. The result is that there exist multiple driven elements 6 and multiple parasitic elements 7 each having a specific resonant frequency, thereby broadbanding the return loss characteristics.

In addition, in the antenna 1, the parasitic elements 7 and driven elements 6 are formed in a single assembly comprising the multiple linear conductors 2. And, in a linear conductor 2 having any cut portion 4, its parasitic elements 7 and driven element 6 are disposed on the same line. Therefore, there is no need of separately disposing additional linear conductors or insulating films unlike conventional methods, thereby reducing the overall size of the antenna. Further, there is no need of assembling additional linear conductors or insulating films in the antenna 1, thereby simplifying the manufacturing process. Furthermore, the antenna 1 is not directional because the parasitic elements 7 and driven element 6 are disposed in close proximity to each other, and therefore can be advantageously used when wishing to broadband an omni-directional antenna.

Figure 2:
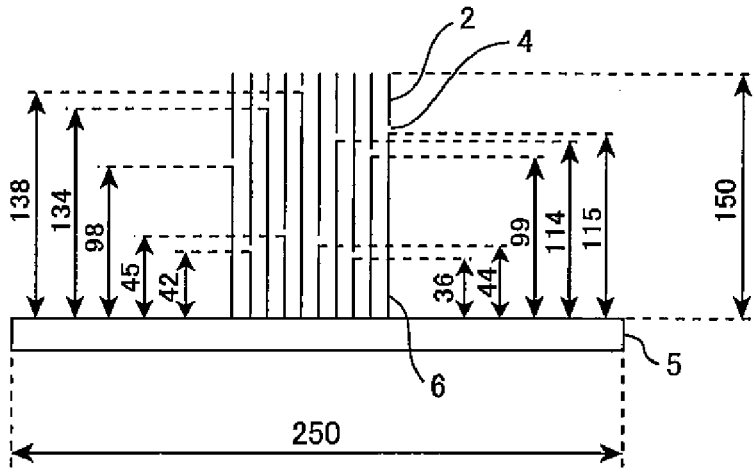
FIG. 2 is a schematic illustration showing a configuration of a trial model for verifying the return loss characteristics of an antenna according to the present invention.

Next, the return loss characteristics will be described with reference to a specific example. FIG. 2 is a schematic illustration showing a configuration of a trial model of this composite monopole antenna for verifying the return loss characteristics of an antenna according to the present invention. This trial model comprises ten parallel 150-mm-length and 20-μm-diameter linear conductors 2 with a pitch of 1.5 mm, in which the lengths of the driven elements 6 from the end on the feed point 5 side to the end on the cut portion 4 side are, from left to right, 98, 42, 134, 45, 138, 44, 114, 36, 99 and 115 mm respectively. The spacings of the cut portions 4 are not particularly specified because the driven elements 6 and the parasitic elements 7 are only required to be electrically open at the cut portions 4. Suppose for example that the length of the driven element 6 and the spacing of the cut portion 4 are 98 and 1 mm respectively, then the length of the parasitic element 7 is given by: 150−98−1=51 mm.

Figure 3:
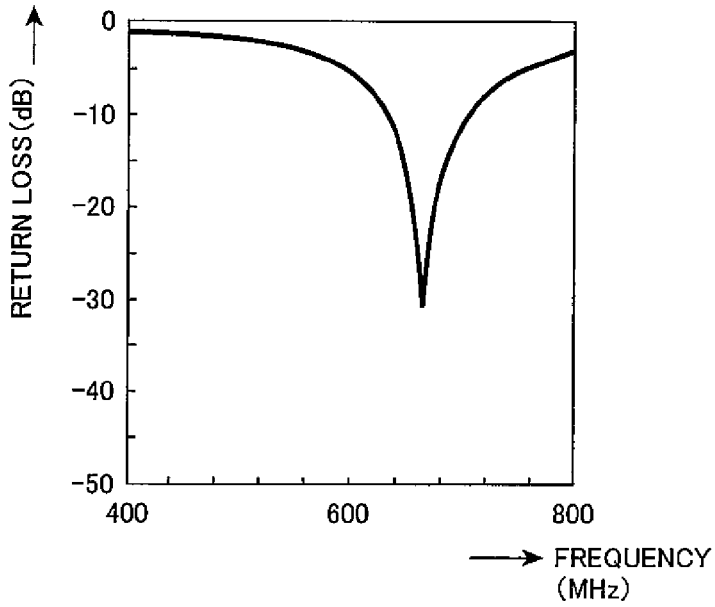
FIG. 3 is a graph illustrating the return loss characteristics of a conventional antenna.
Figure 4:
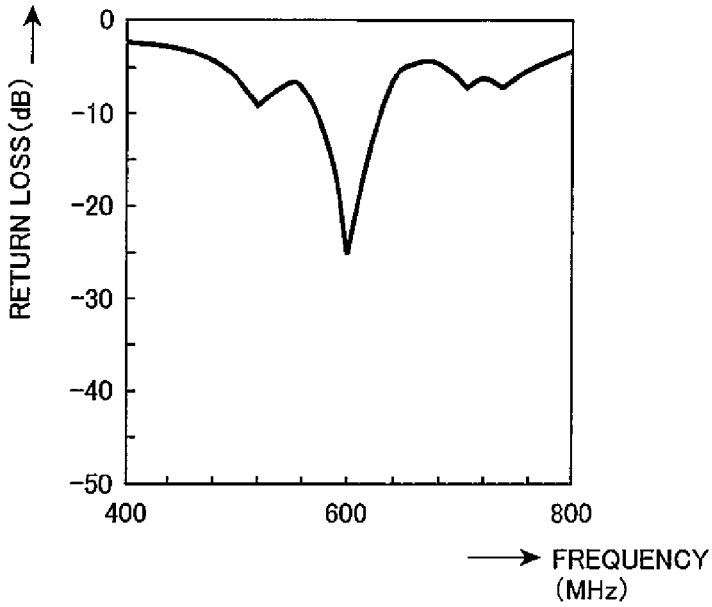
FIG. 4 is a graph illustrating the return loss characteristics of an antenna according to the present invention.

Before forming the cut portions 4, the linear conductors 2 of the composite monopole antenna are all 150 mm long (=driven elements 6) and there is no parasitic element 7. The return loss characteristic of the composite monopole antenna without the cut portions (as a conventional antenna) was measured. FIG. 3 is a graph illustrating the return loss characteristics of the conventional antenna. After that, the linear conductors 2 were cut such that the driven elements 6 had the above-mentioned lengths respectively. Then, the return loss characteristic of the antenna (the composite monopole antenna with the cut portions) was also measured. FIG. 4 is a graph illustrating the return loss characteristics of the antenna according to the present invention. In these return loss characteristics, the lower the ordinate value (dB), the smaller the loss.

As can be seen by comparing FIG. 3 with FIG. 4, the return loss characteristic of FIG. 3 has only one peak corresponding to a smaller loss. By contrast, the return loss characteristic of FIG. 4 has as many as four smaller loss peaks and has a smaller overall loss. This shows that the return loss of FIG. 4 has a broadband characteristic. Therefore, this trial model of the invention can be estimated to have broadbanded return loss characteristics.

Second Embodiment of the Invention

Next, a second embodiment of the present invention will be described.

Figure 5:
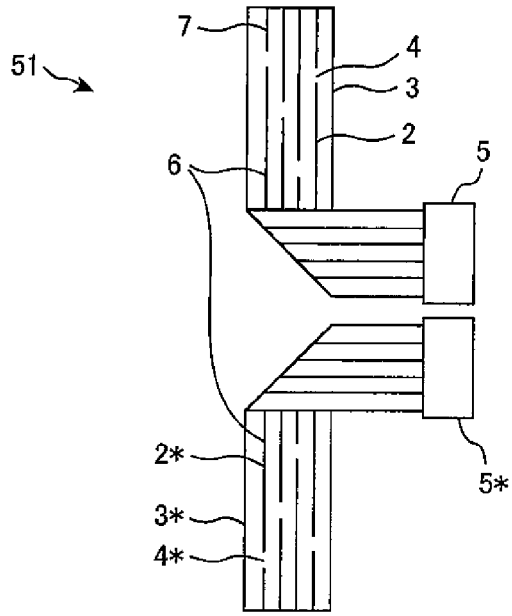
FIG. 5 is a schematic illustration showing another configuration of an antenna according to an embodiment of the present invention.

FIG. 5 is a schematic illustration showing another configuration of an antenna according to an embodiment of the present invention. As shown in FIG. 5, in an antenna 51 according to the invention, two sets of four parallel disposed linear conductors 2, 2* are sandwiched between two insulating films 3, 3* and each linear conductor (2, 2*) is cut at one cut portion (4, 4*).

In this embodiment of FIG. 5, the linear conductors 2 sandwiched between the insulating films 3 are laid in one direction and are folded along a 45-degree angle fold line by 90 degrees, which are connected to a feed point 5. Further, similarly configured linear conductors 2* sandwiched between insulating films 3* are laid in the opposite direction and are folded by 90 degrees in a similar manner, which are connected to another feed point 5* disposed adjacent to the feed point 5.

As shown in FIG. 5, one ends of the four linear conductors 2 and 2* are respectively connected to the feed points 5 and 5*, thereby providing four pairs of driven elements 6 each consisting of the segments of the linear conductors 2 and 2* respectively connected to the feed points 5 and 5*, while the segments of the linear conductors 2 and 2* extending beyond the cut portions 4 and 4* are open at the cut portion ends, thereby providing four pairs of parasitic elements 7 each consisting of the segments of the linear conductors 2 and 2* extending beyond the cut portions 4 and 4*. One ends of a pair of driven elements 6 are connected, near the center of the antenna, to the feed points 5 and 5* respectively, and the other ends are open at cut portions 4 and 4* located at opposite positions from each other, thereby constituting a dipole antenna. The segments of the linear conductors 2 and 2* extending beyond the cut portions 4 and 4* are open not only at the cut portions 4 and 4* but also at the other ends, thereby providing parasitic elements 7.

Therefore, there is configured a composite dipole antenna having two sets each comprising four parallel disposed driven elements 6 of different length and four parallel disposed parasitic elements 7 of different length. The operation, function and advantage of the antenna 51 are similar to those of the antenna 1 of FIG. 1.

Third Embodiment of the Invention

Figure 6:
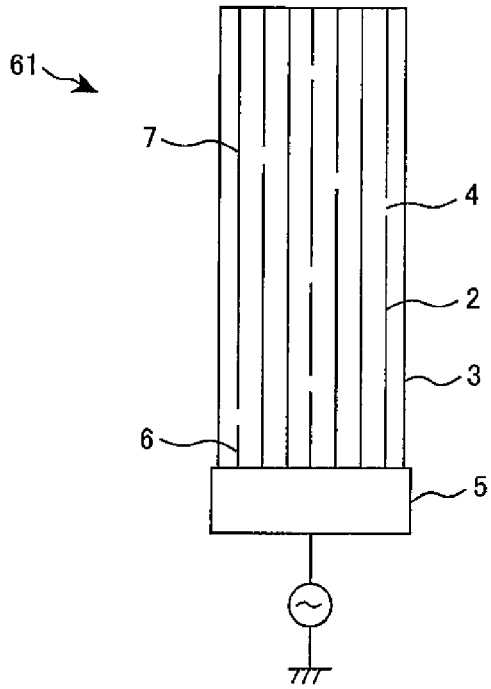
FIG. 6 is a schematic illustration showing another configuration of an antenna according to an embodiment of the present invention.

FIG. 6 is a schematic illustration showing another configuration of an antenna according to an embodiment of the present invention. As shown in FIG. 6, in an antenna 61 according to the invention, seven parallel disposed linear conductors 2 are sandwiched between two insulating films 3 and some of the linear conductors 2 are cut at, at least, one cut portion 4.

Although this embodiment of FIG. 6 is similar to that of FIG. 1, only five of the seven linear conductors 2 have any cut portion 4 and the remaining two have not. Additionally, the middle one of the linear conductors 2 has three cut portions. When there are more than one cut portions in the same linear conductor 2, the parasitic elements 7 are provided by all the remaining segments of the linear conductor 2 other than the far end segment of the linear conductor 2 connected to the feed point 5. Further, when a linear conductor 2 has no cut portion 4, the entire length thereof from one end to the other end provides one driven element 6, and therefore no parasitic element 7 is provided.

Thereby, there is configured a composite monopole antenna comprising seven parallel disposed driven elements 7 of different length and seven parallel disposed parasitic elements 7 of different length. While the antenna 61 differs from the antenna 1 of FIG. 1 in the characteristics of each driven element 6 and parasitic element 7 such as the resonant frequency and impedance, the principal operation, function and advantage thereof is similar to those of the antenna 1 of FIG. 1.

(Structure of Cut Portion and Method for Forming it)

Next, a structure of the cut portion and a method for forming the cut portion will be described.

Figure 7:
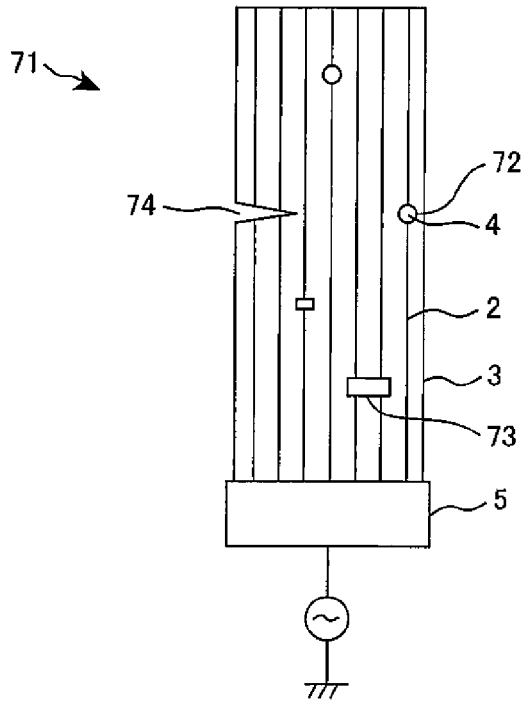
FIG. 7 is a schematic illustration showing another configuration of an antenna for indicating various types of cut portions according to the present invention.

FIG. 7 is a schematic illustration showing another configuration of an antenna for indicating various types of cut portions according to the present invention. As shown in FIG. 7, the cut portions of the antenna 71 are formed in different shapes. Each cut portion 4 is formed by punching or cutting and then removing the insulating films 3 of the cut portion 4 together with the linear conductors 2 sandwiched therebetween. Removal portions 72 and 73 are punched out in round and rectangle shapes, respectively, and a removal portion 74 is cut out in a V shape.

In this manner, the linear conductors 2 having no cutting portion 4 are firstly formed and then sandwiched between the insulating films 3 of the same length as that of the linear conductors 2, and thereafter desired cut portions 4 are determined and removed together with the insulating films 3 between which the linear conductors 2 are sandwiched. As a removing tool, there can be used punches, drills, V-shaped cutters, etc. The shape in which the insulating films 3 are removed is not limited to the illustrated ones, but any other shape may be used only if the linear conductor 2 is electrically open at the cut portion 4.

(Manufacturing Method of the Antenna)

Next, a manufacturing method suitable for a large-scale production of the antenna according to the present invention will be described.

Figure 8:
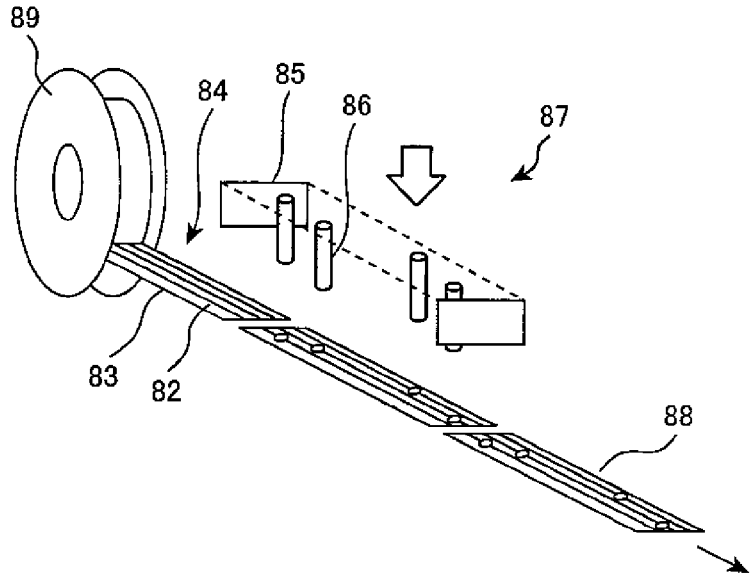
FIG. 8 is a schematic illustration showing a perspective view indicating an example of a manufacturing method suitable for the large-scale production of an antenna according to the present invention.
Figure 9:
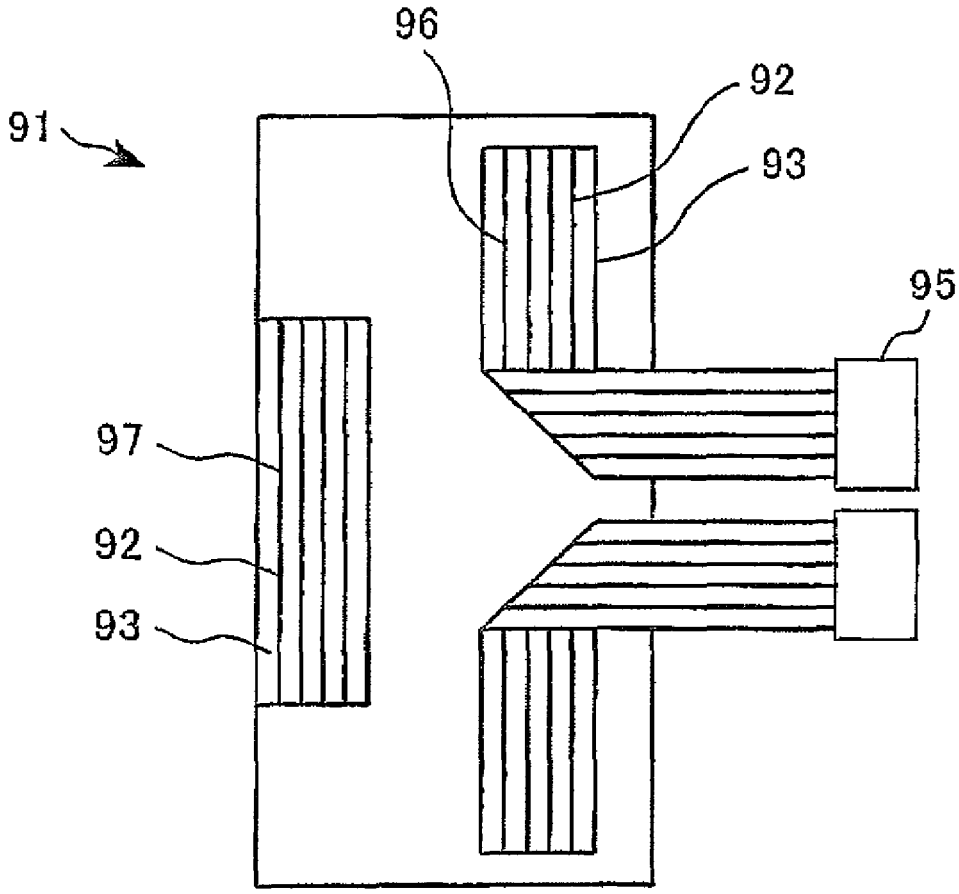
FIG. 9 PRIOR ART
FIG. 9 is a schematic illustration showing a configuration of a conventional antenna.

FIG. 8 is a schematic illustration showing a perspective view indicating an example of a manufacturing method suitable for the large-scale production of an antenna according to the present invention. As shown in FIG. 8, an antenna 88 with a predetermined length and at least one linear conductor 2 being cut at, at least, one location is manufactured as follows. At first, a plurality of long-length linear conductors 82 are parallel disposed and sandwiched between two long-length insulating films 83, thereby forming a long-length antenna material 84. Next, a cutter mold 85 for cutting the antenna material with the entire width or more of the antenna material 84 is set toward the antenna material 84; then, a punch mold 86 is set for punching out the linear conductors 82 together with the insulating films 83 at, at least, one position along the linear conductor 82 at a predetermined distance from the cutter mold 85. Thereafter, the cutter mold 85 and the punch mold 86 are pressed together against the antenna material 84.

In the pressing step, it is preferable to use a jig 87 for holding together the cutter mold 85 and the punch mold 86.

The long-length antenna material 84 is continuously unwound from a drum 89. When the antenna material 84 advances by the length of the antenna 88, the jig 87 is protruded and pressed against the antenna material 84. Thereby, a plurality of cut portions can be formed in the linear conductors 82 simultaneously with cutting the long-length antenna material 84 into antennas 88 of a predetermined length. By repeating this process, the antenna 88 can be efficiently manufactured in a large quantity.

The arrangement of the cut portions 4 are designed such that each driven and parasitic element formed by cutting the linear conductors 2 at the cut portions 4 has a respective desired resonant frequency. In determining the resonant frequencies, a combination thereof optimum for broadbanding return loss characteristics is designed. After thus determining the arrangement of the cut portions 4, the arrangement of the cutter mold 85 and punch molds 86 is then determined to prepare the jig 87.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An antenna comprising:

a plurality of parallel disposed linear conductors;

two insulating films between which the plurality of linear conductors are sandwiched;

a feed point connected to the same side end of the plurality of linear conductors; and at least one cut portion formed in at least one of the plurality of linear conductors, the at least one of the plurality of linear conductors being divided into a driven element and a parasitic element.

2. The antenna according to claim 1, wherein:

the feed point is connected to the same side end of the plurality of linear conductors so and a segment of the linear conductor connected to the feed point provides the driven element and a segment of the linear conductor extended beyond the cut portion provides the parasitic element.

3. The antenna according to claim 1, wherein:

the at least one cut portion is formed in at least two of the plurality of linear conductors such that each cut portion is positioned at a different distance from the same side end of the linear conductors.

4. The antenna according to claim 1, wherein:

the two insulating films are removed at the at least one cut portion.

5. The antenna according to claim 1, wherein the at least one cut portion is formed by punching or cutting and then removing the insulating films of the cut portion together with the linear conductors sandwiched therebetween.

6. The antenna according to claim 1, wherein the at least one cut portion is formed in the plurality of linear conductors such that each cut portion with a different shape is positioned at a different distance from the same side end of the linear conductors.

7. A method for manufacturing an antenna, comprising the steps of:

parallel disposing a plurality of linear conductors;

connecting the same side end of the plurality of linear conductors to a feed point such that the other end thereof is electrically open;

sandwiching the plurality of linear conductors between two insulating films; and subsequently, cutting at least one of the plurality of linear conductors at one or more cut portions, thereby forming a driven element which is a portion of the linear conductors with one end connected to the feed point and forming a parasitic element which is a portion of one of the linear conductors extending beyond its cut portion.

8. The method for manufacturing an antenna according to claim 7, wherein:

in the cutting step, the at least one of the plurality of linear conductors are cut at the at least one cut portion such that each cut portion is positioned at a different distance from the same side end of the linear conductors.

9. The method for manufacturing an antenna according to claim 7, wherein:

in the cutting step, the portions of the two insulating films between which the at least one cut portion is sandwiched are removed simultaneously with cutting the at least one of the plurality of linear conductors.

10. A method for manufacturing an antenna with a predetermined length and at least one linear conductor being cut at, at least, one cut portion, the method comprising the steps of:

forming a long-length antenna material by sandwiching a plurality of parallel disposed long-length liner conductors between two long-length insulating films;

setting a cutter mold for cutting the antenna material;

setting a punch mold for punching out at least one of the linear conductors together with the insulating films at, at least, one position along the linear conductor at a predetermined distance from the cutter mold; and pressing together the cutter mold and punch mold against the antenna material, wherein in the pressing step, a jig is used for holding together the cutter mold and punch mold.

* * * * *